US010428839B2

(12) United States Patent
Chang et al.

(10) Patent No.: US 10,428,839 B2
(45) Date of Patent: Oct. 1, 2019

(54) VIBRATION DAMPER STRUCTURE AND SERIES FAN THEREOF

(71) Applicant: ASIA VITAL COMPONENTS CO., LTD., New Taipei (TW)

(72) Inventors: Bor-Haw Chang, New Taipei (TW); Yu-Tzu Chen, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 266 days.

(21) Appl. No.: 15/401,088

(22) Filed: Jan. 8, 2017

(65) Prior Publication Data

US 2018/0195530 A1 Jul. 12, 2018

(51) Int. Cl.

| | |
|---|---|
| ***F04D 29/66*** | (2006.01) |
| ***F04D 19/00*** | (2006.01) |
| ***F04D 25/06*** | (2006.01) |
| ***F04D 29/64*** | (2006.01) |

(52) U.S. Cl.

CPC ..... *F04D 29/668* (2013.01); *F04D 19/007* (2013.01); *F04D 25/062* (2013.01); *F04D 29/646* (2013.01)

(58) Field of Classification Search

CPC ..... F04D 29/668; F04D 29/05; F04D 29/66; F04D 29/601

USPC ..... 415/119

See application file for complete search history.

(56) References Cited

U.S. PATENT DOCUMENTS

| | | | | |
|---|---|---|---|---|
| 4,719,352 | A * | 1/1988 | Miyatake | F16C 25/083 250/343 |
| 8,057,173 | B2 * | 11/2011 | Chen | F04D 29/059 415/229 |
| 8,613,558 | B2 * | 12/2013 | Takahashi | F16C 19/06 248/578 |
| 2007/0013247 | A1 * | 1/2007 | Tung | F04D 29/0513 310/90 |
| 2008/0008576 | A1 * | 1/2008 | Hong | F04D 19/007 415/68 |
| 2010/0021317 | A1 * | 1/2010 | Hanaoka | F04D 19/007 417/244 |
| 2015/0023786 | A1 * | 1/2015 | Li | F04D 29/646 415/199.4 |
| 2016/0298490 | A1 * | 10/2016 | Hettinger | F01D 25/164 |

* cited by examiner

*Primary Examiner* — Dwayne J White
*Assistant Examiner* — Wesley Le Fisher
(74) *Attorney, Agent, or Firm* — Jackson IPG PLLC; Demian K. Jackson

(57) ABSTRACT

A vibration damper structure and a series fan thereof. The vibration damper structure includes a first support body, a second support body and an elastic member. The first support body has a first upper end and a first lower end. The second support body has a second upper end and a second lower end. The elastic member is disposed between the first and second support bodies. The elastic member has a first support end in contact with the first lower end and a second support end in contact with the second lower end. The vibration damper structure is applied to the series fan to greatly reduce the vibration of the series fan in operation.

17 Claims, 8 Drawing Sheets

VIBRATION DAMPER STRUCTURE AND SERIES FAN THEREOF

BACKGROUND OF THE INVENTION

1. Field of the Invention

The present invention relates generally to a vibration damper structure and a series fan thereof and, more particularly, to a vibration damper structure which is able to reduce the vibration of the fan in rotation and a series fan with the vibration damper structure.

2. Description of the Related Art

In the flourishing development of current information technology, a mass of information data needs to be calculated, integrated, transmitted, and stored. In order to deal with such data, the server base station comes with the tide of fashion. According to different calculation abilities, the servers can be classified into a work-group-grade server, a department-grade server, and an enterprise-grade server.

With the server as hardware, generally the server means those computers with higher calculation ability and capable of providing service for multiple subscribers. In comparison with a common PC, the server needs to work continuously 24/7. This means that the server requires a more stable technique to ensure data transmission.

The disk drive in the server will detect the magnitude of vibration and feed back to the reading/writing head so as to control the reading/writing head and ensure the trueness of reading/writing. Under such circumstance, the reading/writing speed will be affected. In order to achieve the highest reading/writing efficiency, the storage device manufacturers and/or server manufacturers often evaluate the magnitude of the vibration of the hard disk on the basis of the rotation vibration (RV) of the hard disk. In general, in order to raise the reading/writing efficiency, not only the structural characteristic of the hard disk itself is actively enhanced, but also a cushion pad or vibration damping material is passively added to minimize the affects of the vibration to the hard disk.

Another vibration source is the cooling fan disposed in the server for dissipating the heat. The respective fan manufacturers also have actively improved the efficiency of the motor and the fan blades to lower the transmission of the vibration to the hard disk. Alternatively, a cushion pad or vibration damping material is passively added onto the fan support so as to reduce the vibration caused by the fan and enhance the reading/writing efficiency of the hard disk. However, as a whole, the effect is still limited. For example, while reducing the vibration, the heat dissipation ability may be sacrificed or the additional mechanical component may lead to increase of the cost.

It is therefore tried by the applicant to provide a vibration damper structure and a series fan with the vibration damper structure to solve the above problems of the conventional fan.

SUMMARY OF THE INVENTION

It is therefore a primary object of the present invention to provide a vibration damper structure, which is able to reduce the vibration of the fan in operation.

It is a further object of the present invention to provide a series fan with the vibration damper structure.

To achieve the above and other objects, the vibration damper structure of the present invention is applied to a series fan. The series fan includes a first fan having at least one first bearing and a second fan having at least one second bearing and a serial connection face between the first and second fans. The vibration damper structure includes a first support body, a second support body and an elastic member. The first support body has a first upper end and a first lower end. The first upper end supports the first bearing. The second support body has a second upper end and a second lower end. The second upper end supports the second bearing. The elastic member is disposed between the first and second support bodies to cross over the serial connection face. The elastic member has a first support end in contact with the first lower end and a second support end in contact with the second lower end.

Still to achieve the above and other objects, the series fan of the present invention includes a first frame body, a second frame body and a vibration damper structure. The first frame body has a first opening and a second opening. A first base seat is disposed at the second opening. A first bearing cup is disposed on the first base seat. At least one first bearing is disposed in the first bearing cup. A first stator assembly is fitted around the first bearing cup corresponding to a first rotor assembly. The first rotor assembly has a first shaft inserted into the first bearing cup through the first bearing. The second frame body has a third opening and a fourth opening. A second base seat is disposed at the fourth opening. A second bearing cup is disposed on the second base seat. At least one second bearing is disposed in the second bearing cup. A second stator assembly is fitted around the second bearing cup corresponding to a second rotor assembly. The second rotor assembly has a second shaft inserted into the second bearing cup through the second bearing. The fourth opening of the second frame body faces the second opening of the first frame body and the first and second frame bodies are mated and connected with each other to define a serial connection face. The vibration damper structure includes a first support body, a second support body and an elastic member. The first support body is disposed in the first bearing cup and positioned under the first bearing. The first support body has a first upper end and a first lower end. The first upper end supports the first bearing. The second support body is disposed in the second bearing cup and positioned under the second bearing. The second support body has a second upper end and a second lower end. The second upper end supports the second bearing. The elastic member is disposed between the first and second support bodies to cross over the serial connection face. The elastic member has a first support end in contact with the first lower end and a second support end in contact with the second lower end.

In the above series fan, the first lower end is formed with a first protrusion section and the second lower end is formed with a second protrusion section. The first support end is positioned in the first protrusion section. The second support end is positioned in the second protrusion section.

In the above series fan, a support tubular member is disposed between the first and second support bodies. The support tubular member has a first open end facing the first support body and a second open end facing the second support body. The first lower end is formed with a first stepped section and a first restriction section and the second lower end is formed with a second stepped section and a second restriction section. The first open end of the support tubular member is fitted on the first stepped section to face the first restriction section. The second open end of the support tubular member is fitted on the second stepped section to face the second restriction section.

In the above series fan, the first open end defines an inner diameter larger than an outer diameter of the first stepped section and the second open end defines an inner diameter larger than an outer diameter of the second stepped section. An axial cushion gap is defined between the first open end and the first restriction section. An axial cushion gap is defined between the second open end and the second restriction section.

In the above series fan, the elastic member is selected from a group consisting of a hydraulic damper, a pneumatic damper or a spring damper.

In the above series fan, the first and second frame bodies are connected with each other by means of engagement, locking, insertion, adhesion, latching or slide rails.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
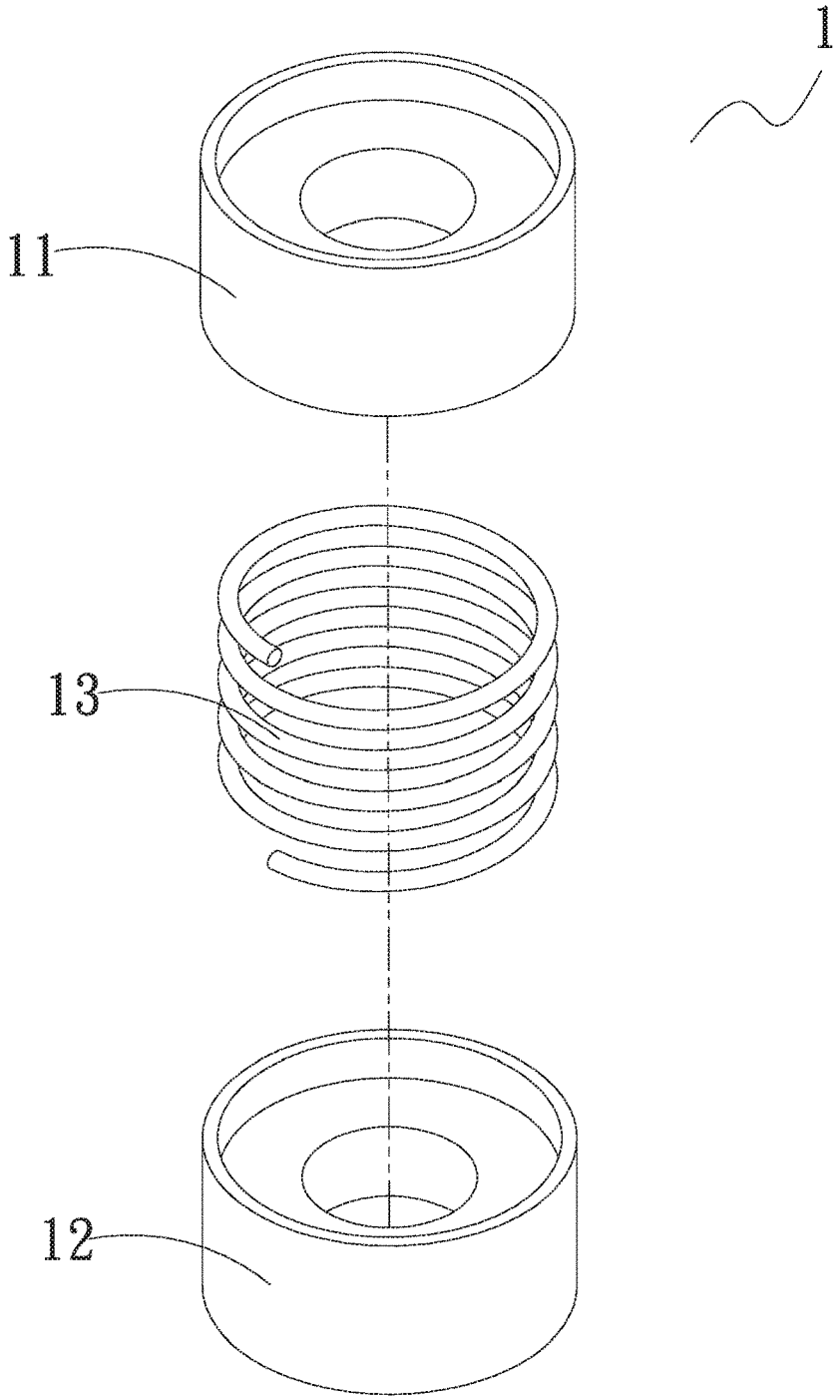
FIG. 1A is a perspective exploded view of a first embodiment of the vibration damper structure of the present invention.
Figure 1B:
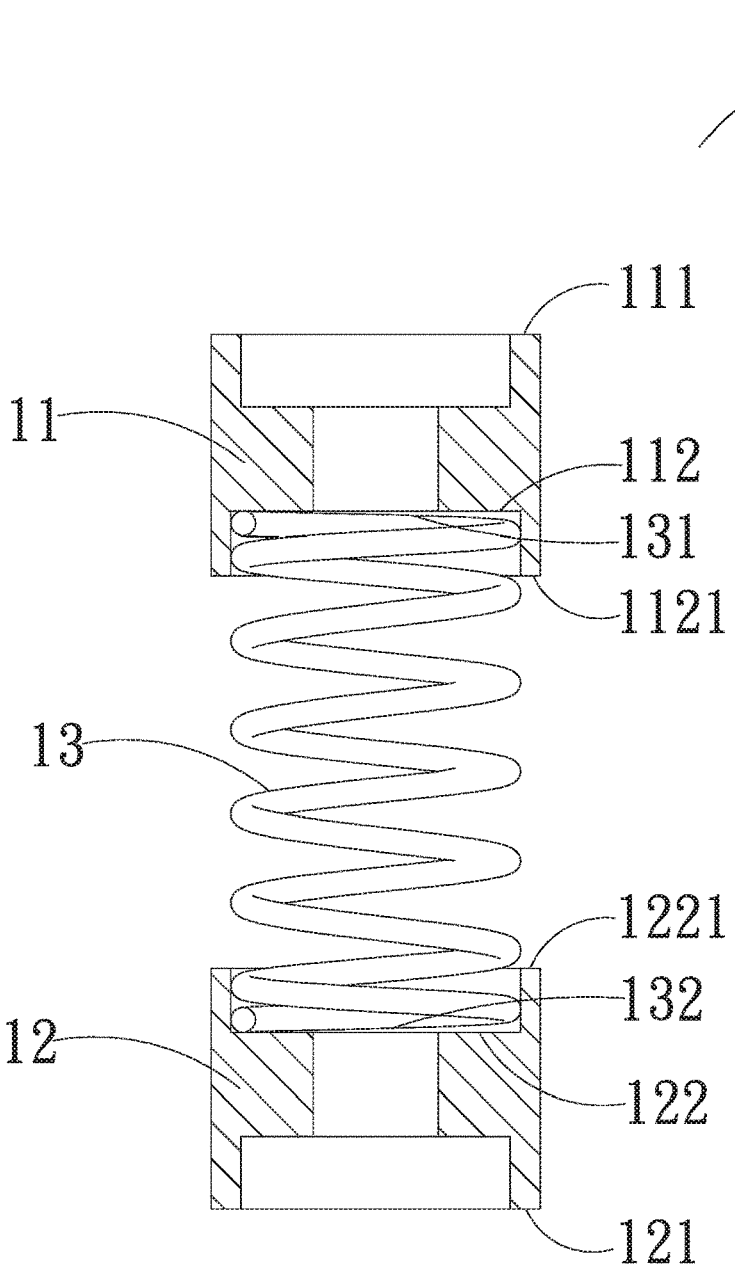
FIG. 1B is a sectional assembled view of the first embodiment of the vibration damper structure of the present invention.
Figure 2A:
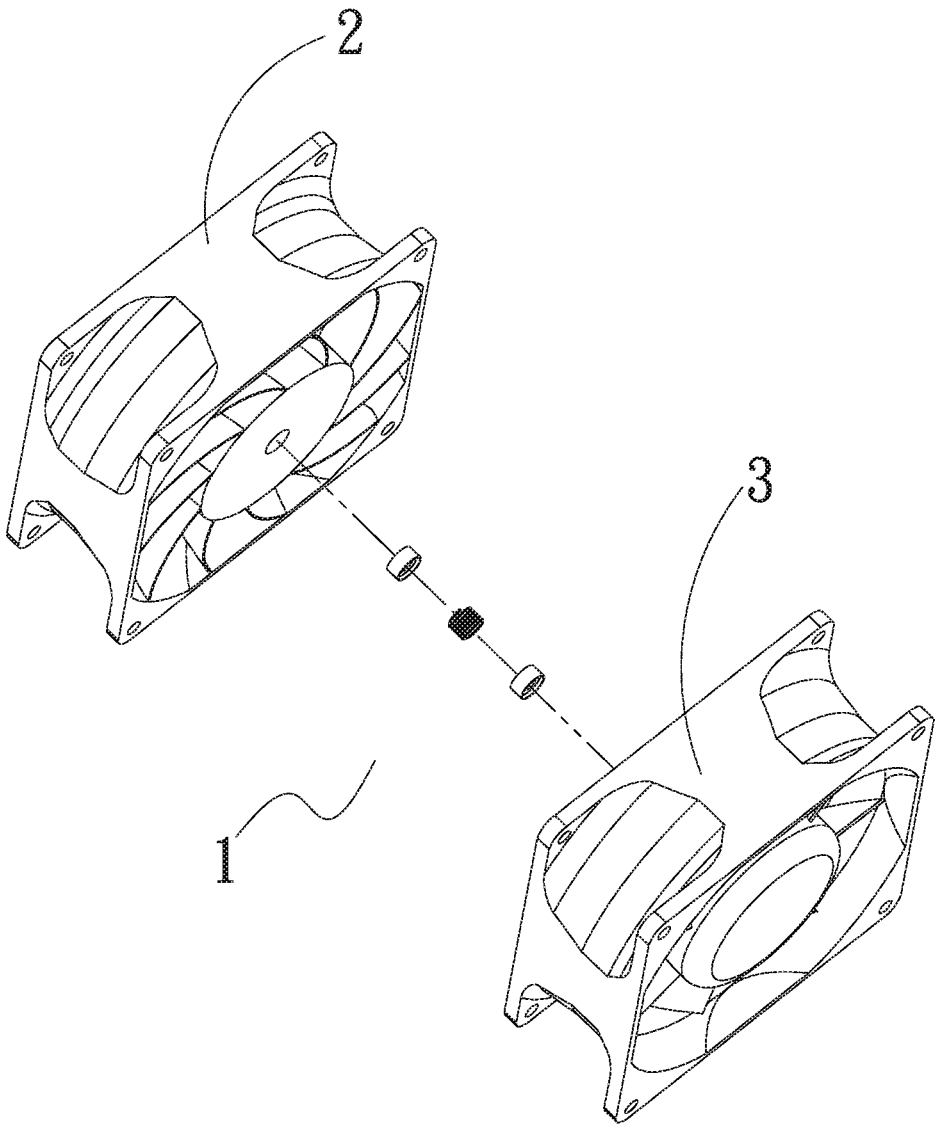
FIG. 2A is a perspective exploded view of the series fan of the present invention.
Figure 2B:
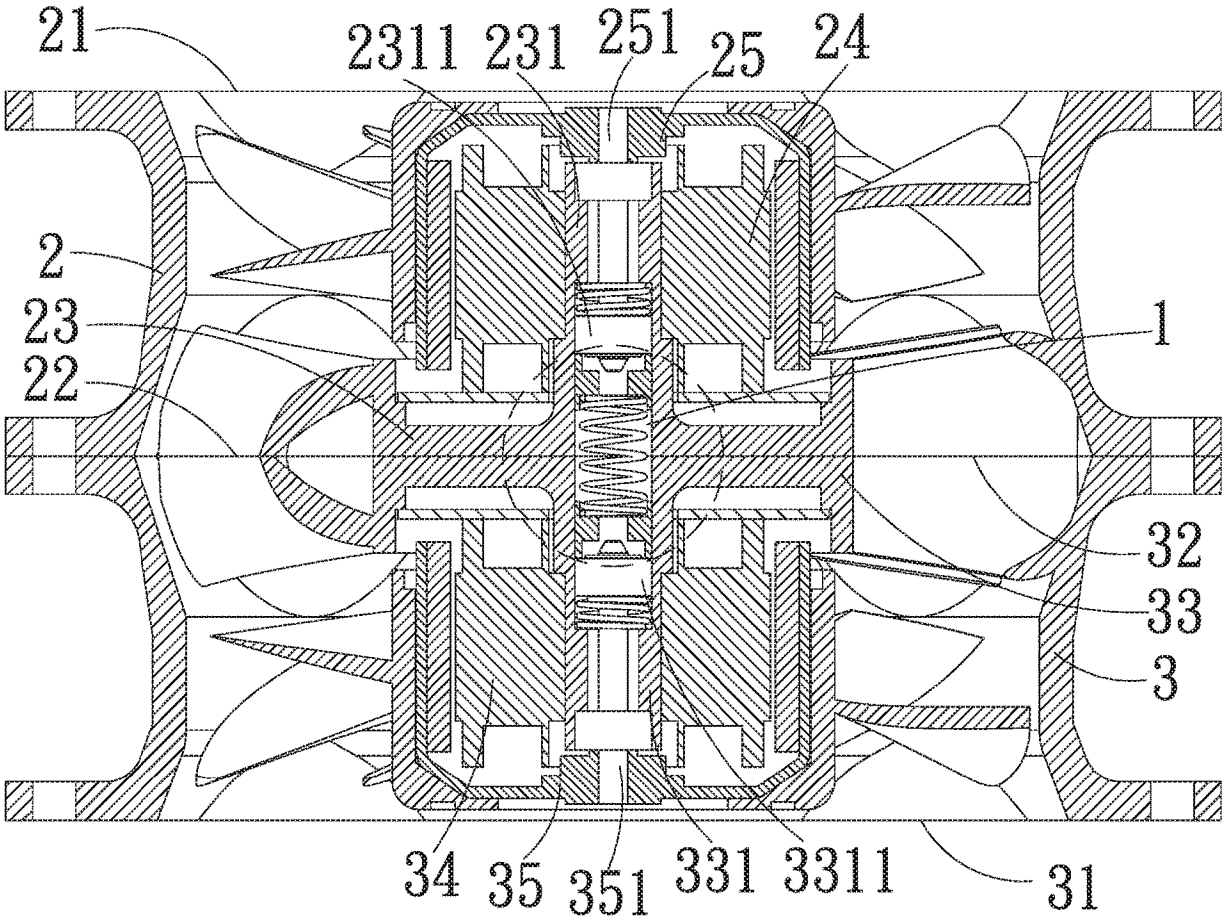
FIG. 2B is a sectional assembled view of the series fan of the present invention.
Figure 2C:
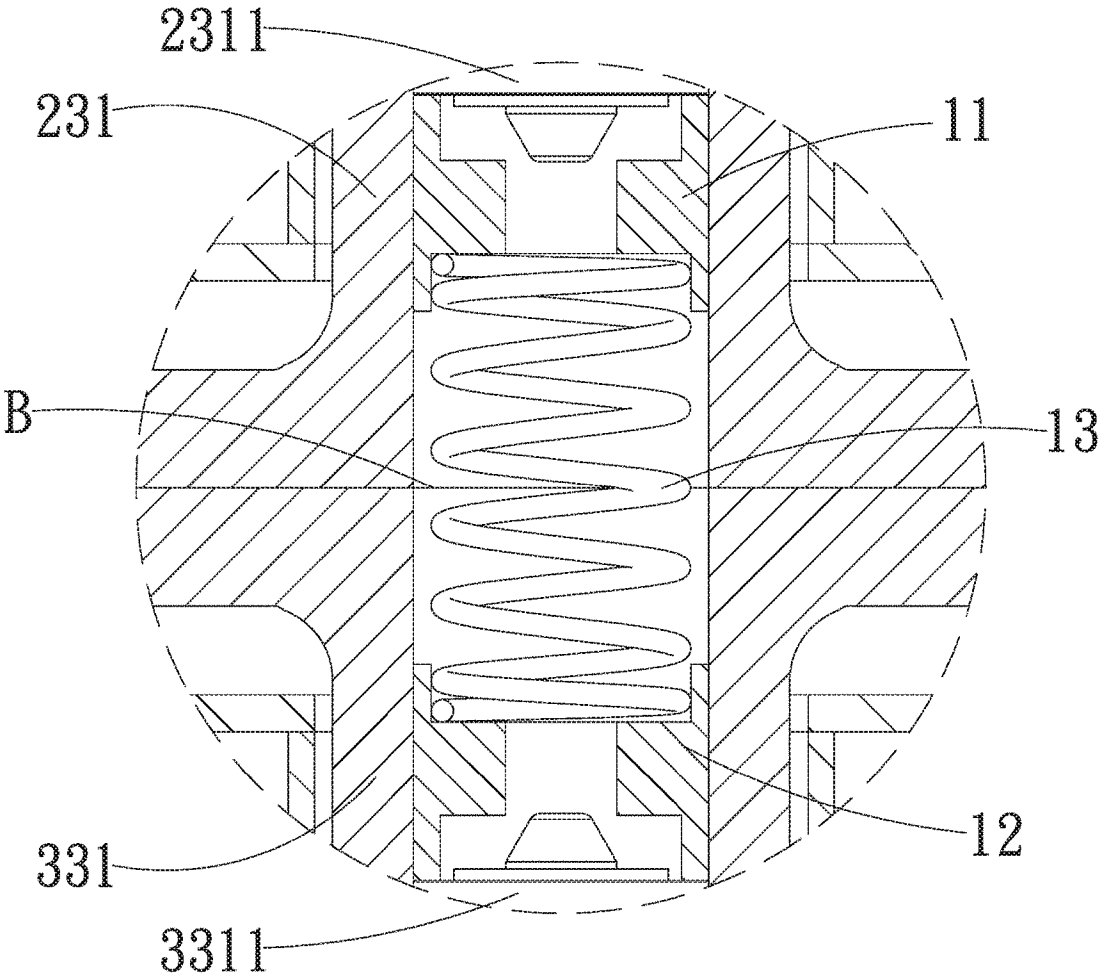
FIG. 2C is an enlarged view of circled area of FIG. 2B.
Figure 3A:
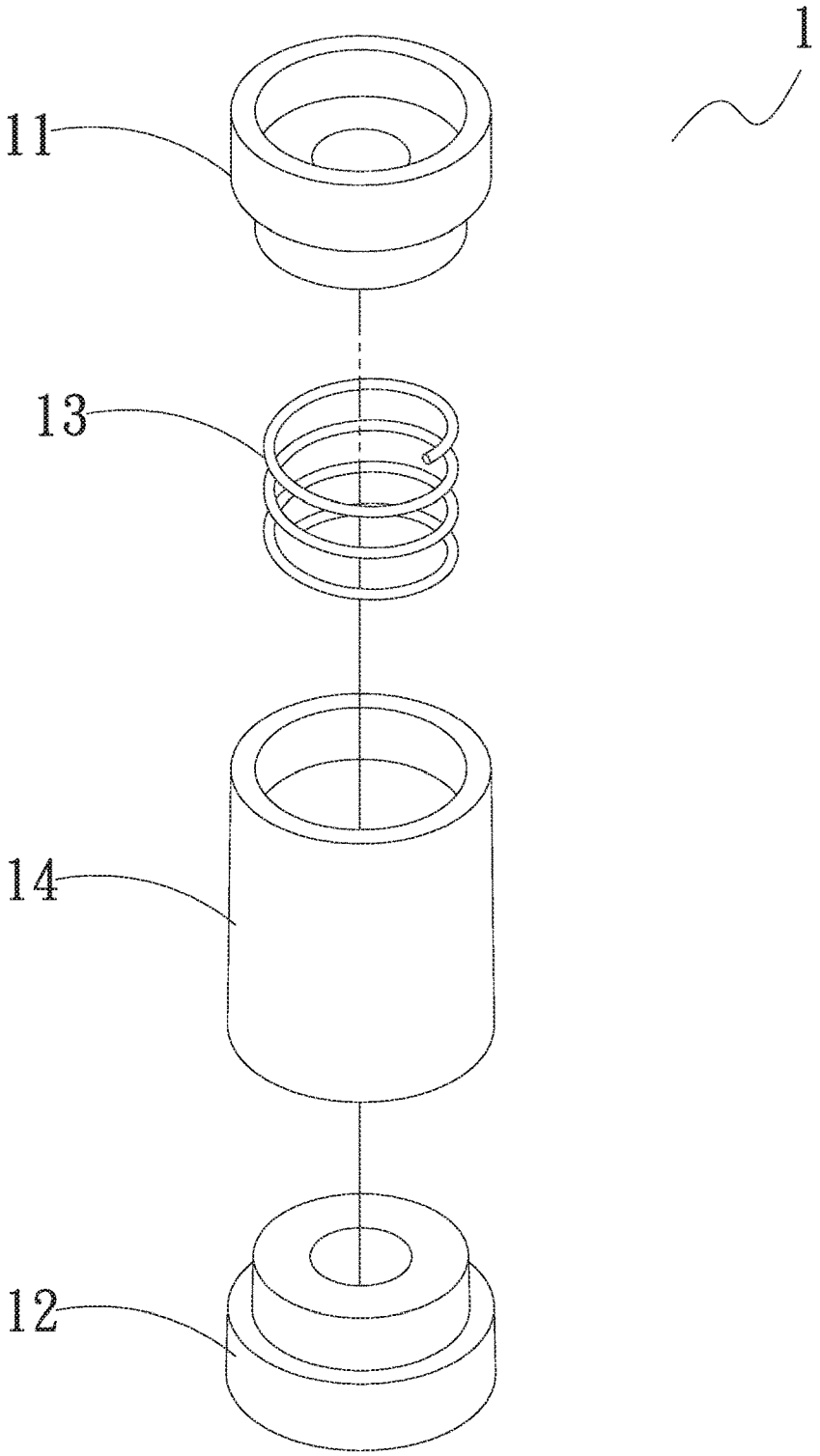
FIG. 3A is a perspective exploded view of a second embodiment of the vibration damper structure of the present invention.
Figure 3B:
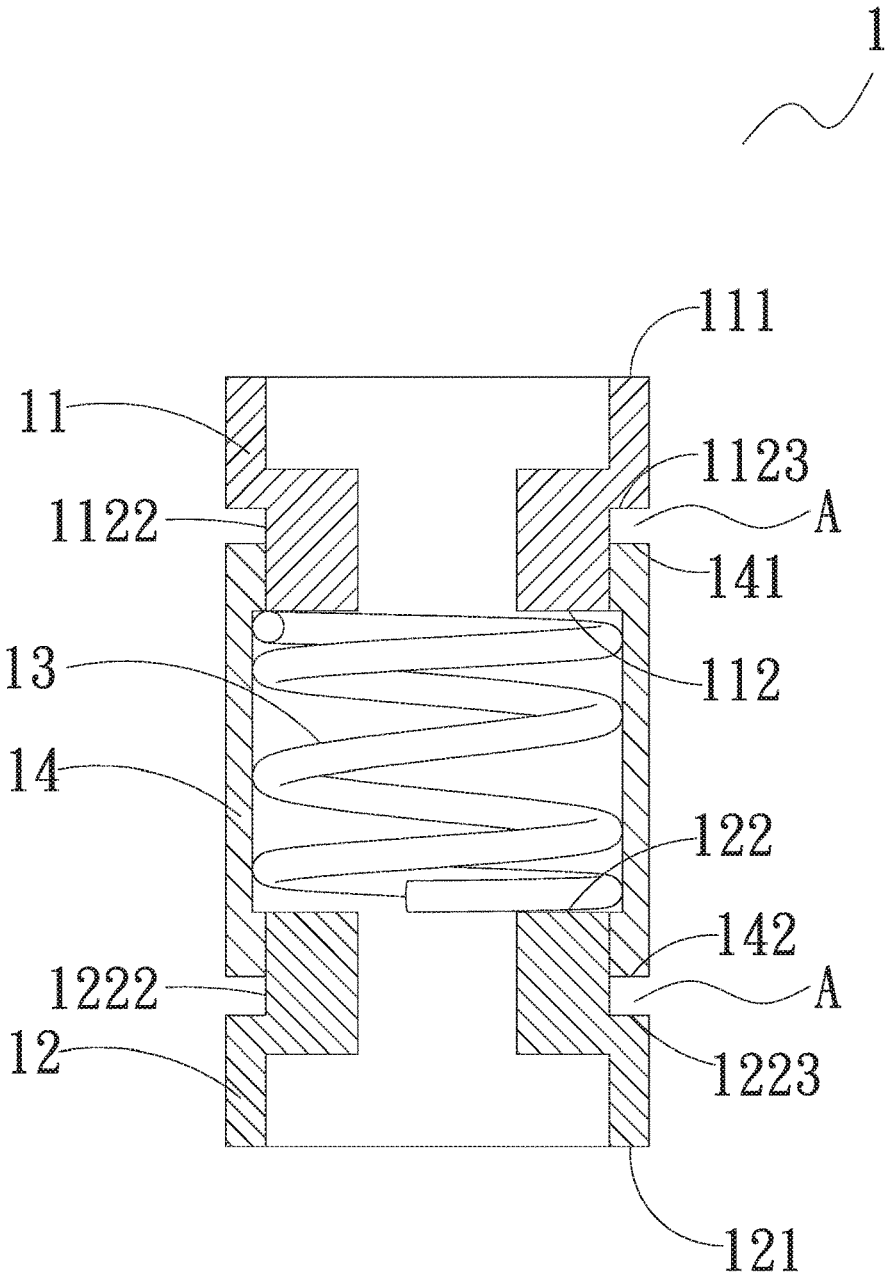
FIG. 3B is a sectional assembled view of the second embodiment of the vibration damper structure of the present invention.
Figure 3C:
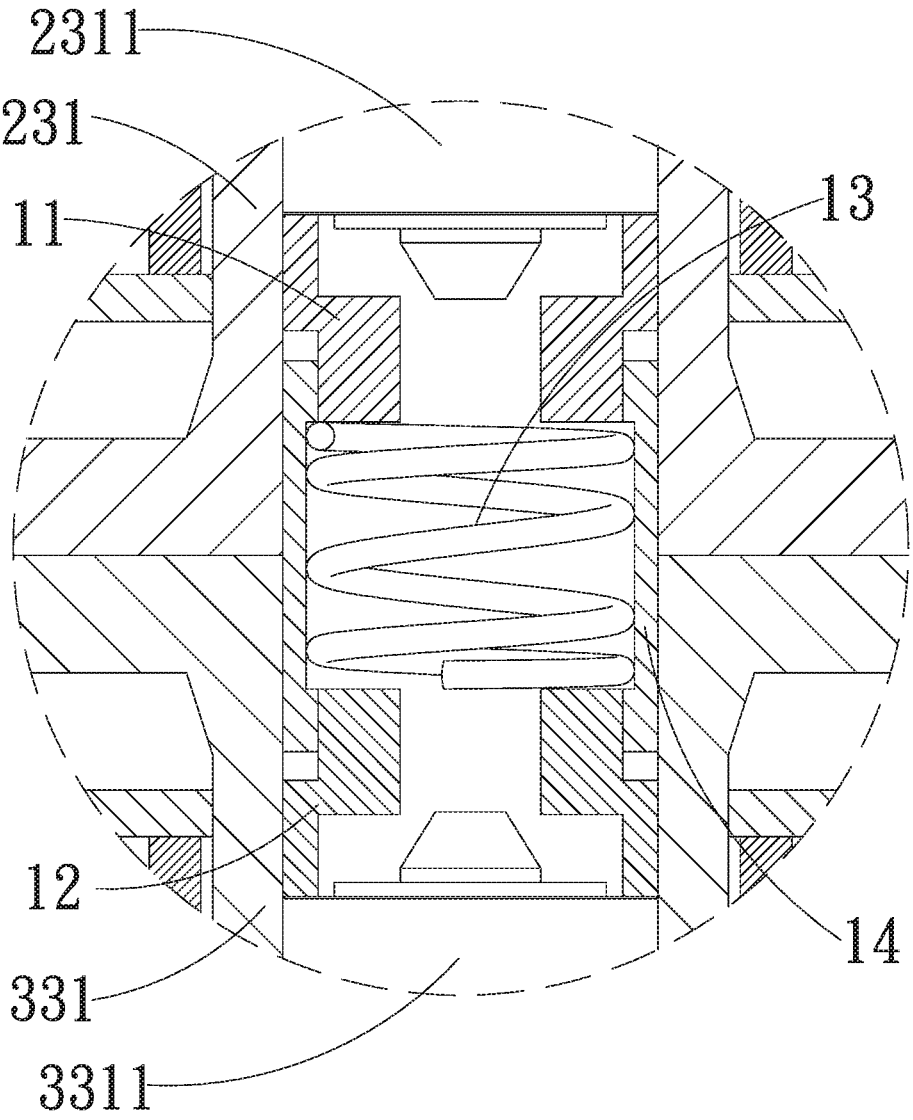
FIG. 3C is a partially sectional view showing that the second embodiment of the vibration damper structure is applied to the series fan of the present invention.

FIG. 1A is a perspective exploded view of a first embodiment of the vibration damper structure of the present invention. FIG. 1B is a sectional assembled view of the first embodiment of the vibration damper structure of the present invention. FIG. 2A is a perspective exploded view of the series fan of the present invention. FIG. 2B is a sectional assembled view of the series fan of the present invention. FIG. 2C is an enlarged view of circled area of FIG. 2B. FIG. 3A is a perspective exploded view of a second embodiment of the vibration damper structure of the present invention. FIG. 3B is a sectional assembled view of the second embodiment of the vibration damper structure of the present invention. FIG. 3C is a partially sectional view showing that the second embodiment of the vibration damper structure is applied to the series fan of the present invention.

Please refer to FIGS. 1A and 1B. The first embodiment of the vibration damper structure 1 of the present invention includes a first support body 11, a second support body 12 and an elastic member 13. The first support body 11 has a first upper end 111 and a first lower end 112 opposite to the first upper end 111. The first lower end 112 is formed with a first protrusion section 1121.

The second support body 12 has a second upper end 121 and a second lower end 122 opposite to the second upper end 121. The second lower end 122 is formed with a second protrusion section 1221.

The elastic member 13 is positioned between the first and second support bodies 11, 12. The elastic member 13 has a first support end 131 and a second support end 132. The first support end 131 contacts the first lower end 112, while the second support end 132 contacts the second lower end 122. The elastic member 13 is such as, but not limited to, a hydraulic damper, a pneumatic damper or a spring damper.

The first support end 131 is positioned in the first protrusion section 1121, while the second support end 132 is positioned in the second protrusion section 1221. The first and second protrusion sections 1121, 1221 are fitted on two ends of the elastic member 13 to prevent the elastic member 13 from deflecting after compressed.

Please now refer to FIGS. 2A, 2B and 2C and supplementally refer to FIGS. 1A and 1B. The series fan of the present invention includes a first frame body 2, a second frame body 3 and the vibration damper structure 1. The first frame body 2 has a first opening 21 and a second opening 22. A first base seat 23 is disposed at the second opening 22. The first base seat 23 has a first bearing cup 231. A first bearing 2311 is disposed in the first bearing cup 231. A first stator assembly 24 is fitted around the first bearing cup 231. A first rotor assembly 25 corresponds to the first stator assembly 24. The first rotor assembly 25 has a first shaft 251 inserted into the first bearing cup 231 through the first bearing 2311.

The second frame body 3 has a third opening 31 and a fourth opening 32. A second base seat 33 is disposed at the fourth opening 32. The second base seat 33 has a second bearing cup 331. A second bearing 3311 is disposed in the second bearing cup 331. A second stator assembly 34 is fitted around the second bearing cup 331. A second rotor assembly 35 corresponds to the second stator assembly 34. The second rotor assembly 35 has a second shaft 351 inserted into the second bearing cup 331 through the second bearing 3311.

The second opening 22 of the first frame body 2 faces the fourth opening 32 of the second frame body 3 and the first frame body 2 and the second frame body 3 are fixedly mated and connected with each other. The mating face between the second and fourth openings 22, 32 is defined as a serial connection face B (as shown in FIG. 2C). The first and second frame bodies 2, 3 are secured to each other with the base seats mated with each other. The vibration damper structure 1 is positioned between the first and second frame bodies 2, 3. The first support body 11 is disposed in the first bearing cup 231 and positioned under the first bearing 2311. The second support body 12 is disposed in the second bearing cup 331 and positioned under the second bearing 3311. The elastic member 13 crosses over the serial connection face B with two sides respectively positioned in the first and second bearing cups 231, 331. The first and second frame bodies 2 and 3 are connected with each other by means of engagement, locking, insertion, adhesion, latching or slide rails. In this embodiment, when the series fan operates, the vibration of the first and second rotor assemblies 25, 35 is respectively transmitted from the first and second support bodies 11, 12 to the elastic member 13 for absorbing the vibration.

Please now refer to FIGS. 3A, 3B and 3C and supplementally refer to FIGS. 2A and 2B. The second embodiment of the vibration damper structure 1 of the present invention includes a first support body 11, a second support body 12, an elastic member 13 and a support tubular member 14. The first upper end 111 of the first support body 11 and the second upper end 121 of the second support body 12 are as the first embodiment and thus will not be repeatedly described hereinafter. The second embodiment is mainly different from the first embodiment in that the first lower end 112 of the first support body 11 is formed with a first stepped section 1122 and a first restriction section 1123. The second lower end 122 is formed with a second stepped section 1222 and a second restriction section 1223. A first open end 141 of the support tubular member 14 is fitted on the first stepped section 1122 to face the first restriction section 1123. A second open end 142 of the support tubular member 14 is fitted on the second stepped section 1222 to face the second restriction section 1223.

The elastic member 13 is received in the support tubular member 14. The first open end 141 defines an inner diameter larger than an outer diameter of the first stepped section 1122. The second open end 142 defines an inner diameter larger than an outer diameter of the second stepped section 1222. Accordingly, the first and second stepped sections 1122, 1222 are axially movable within the support tubular member 14. When the elastic member 13 is in a not forced state, an axial cushion gap A is defined between the first restriction section 1123 and the first open end 141 and an axial cushion gap A is defined between the second restriction section 1223 and the second open end 142. When the elastic member 13 is in a forced state, the axial cushion gap A is shortened and the first and second restriction sections 1123, 1223 respectively contact the support tubular member 14. The length of the axial cushion gap A can be set according to the requirement of use.

In conclusion, in comparison with the conventional series cooling fan, the present invention has the following advantages:

1. The present invention has very good vibration absorption effect.
2. The present invention co-uses a set of vibration damper structure to lower the cost.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A vibration damper structure applied to a series fan, the series fan comprising a first fan having a first shaft inserted into at least one first bearing;

a first bearing cup receiving the at least one first bearing;

a second fan having a second shaft inserted into at least one second bearing, the first and second shafts arranged along an axial line;

a second bearing cup receiving the at least one second bearing, the first and second bearing cups each having bottom openings mated and connected with each other; and a serial connection face between the first and second fans, the vibration damper structure comprising:

a first support body received in the first bearing cup, coaxial with the first shaft and having a first upper end and a first lower end, the first upper end supporting the first bearing;

a second support body received in the second bearing cup, coaxial with the second shaft and having a second upper end and a second lower end, the second upper end supporting the second bearing; and an elastic member disposed between and enclosed by the first and second support bodies and first and second bearing cups along the axial line to cross over the serial connection face, wherein a gap is defined between inner walls of the first and second bearing cups and the elastic member and the elastic member having a first support end in contact with the first lower end and a second support end in contact with the second lower end.

2. The vibration damper structure as claimed in claim 1, wherein the first lower end is formed with a first protrusion section and the second lower end is formed with a second protrusion section, the first support end being positioned in the first protrusion section, the second support end being positioned in the second protrusion section.

3. The vibration damper structure as claimed in claim 1, wherein a support tubular member is disposed between the first and second support bodies, the support tubular member having a first open end facing the first support body and a second open end facing the second support body.

4. The vibration damper structure as claimed in claim 3, wherein the first lower end is formed with a first stepped section and a first restriction section and the second lower end is formed with a second stepped section and a second restriction section, the first open end of the support tubular member being fitted on the first stepped section to face the first restriction section, the second open end of the support tubular member being fitted on the second stepped section to face the second restriction section.

5. The vibration damper structure as claimed in claim 4, wherein the first open end defines an inner diameter larger than an outer diameter of the first stepped section and the second open end defines an inner diameter larger than an outer diameter of the second stepped section.

6. The vibration damper structure as claimed in claim 4, wherein an axial cushion gap is defined between the first open end and the first restriction section.

7. The vibration damper structure as claimed in claim 4, wherein an axial cushion gap is defined between the second open end and the second restriction section.

8. The vibration damper structure as claimed in claim 1, wherein the elastic member is selected from a group consisting of a hydraulic damper, a pneumatic damper or a spring damper.

9. A series fan comprising:

a first frame body having a first opening and a second opening, a first base seat being disposed at the second opening, a first bearing cup being disposed on the first base seat, at least one first bearing being disposed in the first bearing cup, a first stator assembly being fitted around the first bearing cup corresponding to a first rotor assembly, the first rotor assembly having a first shaft inserted into the first bearing cup through the first bearing;

a second frame body having a third opening and a fourth opening, a second base seat being disposed at the fourth opening, a second bearing cup being disposed on the second base seat, the first and second bearing cups each having bottom openings mated and connected with each other, at least one second bearing being disposed in the second bearing cup, a second stator assembly being fitted around the second bearing cup corresponding to a second rotor assembly, the second rotor assembly having a second shaft coaxial with the first shaft and inserted into the second bearing cup through the second bearing, the fourth opening of the second frame body facing the second opening of the first frame body and the first and second frame bodies being mated and connected with each other to define a serial connection face; and a vibration damper structure including:

a first support body coaxial with the first shaft and disposed in the first bearing cup and positioned under the first bearing, the first support body having a first upper end and a first lower end, the first upper end supporting the first bearing;

a second support body coaxial with the second shaft and disposed in the second bearing cup and positioned under the second bearing, the second support body having a second upper end and a second lower end, the second upper end supporting the second bearing; and an elastic member coaxial with the first and second support bodies and disposed between and enclosed by the first and second support bodies and the first and second bearing cups to cross over the serial connection face, wherein a gap is defined between inner walls of the first and second bearing cups and the elastic member and the elastic member having a first support end in contact with the first lower end and a second support end in contact with the second lower end.

10. The series fan as claimed in claim 9, wherein the first lower end is formed with a first protrusion section and the second lower end is formed with a second protrusion section, the first support end being positioned in the first protrusion section, the second support end being positioned in the second protrusion section.

11. The series fan as claimed in claim 9, wherein a support tubular member is disposed between the first and second support bodies, the support tubular member having a first open end facing the first support body and a second open end facing the second support body.

12. The series fan as claimed in claim 11, wherein the first lower end is formed with a first stepped section and a first restriction section and the second lower end is formed with a second stepped section and a second restriction section, the first open end of the support tubular member being fitted on the first stepped section to face the first restriction section, the second open end of the support tubular member being fitted on the second stepped section to face the second restriction section.

13. The series fan as claimed in claim 12, wherein the first open end defines an inner diameter larger than an outer diameter of the first stepped section and the second open end defines an inner diameter larger than an outer diameter of the second stepped section.

14. The series fan as claimed in claim 12, wherein an axial cushion gap is defined between the first open end and the first restriction section.

15. The series fan as claimed in claim 12, wherein an axial cushion gap is defined between the second open end and the second restriction section.

16. The series fan as claimed in claim 9, wherein the elastic member is selected from a group consisting of a hydraulic damper, a pneumatic damper or a spring damper.

17. The series fan as claimed in claim 9, wherein the first and second frame bodies are connected with each other by means of engagement, locking, insertion, adhesion, latching or slide rails.

* * * * *